United States Patent [19]

Tabata

[11] 4,416,612

[45] Nov. 22, 1983

[54] CIGARETTE LIGHTER

[75] Inventor: Hiromaro Tabata, Tokyo, Japan

[73] Assignee: Miki Corporation, Tokyo, Japan

[21] Appl. No.: 298,434

[22] Filed: Sep. 1, 1981

[30] Foreign Application Priority Data

Nov. 6, 1980 [JP] Japan ..... 55-155233

[51] Int. Cl.[3] ..... F23Q 2/16

[52] U.S. Cl. ..... 431/131; 431/150; 431/277

[58] Field of Search ..... 431/129, 130, 131, 136, 431/133, 137, 138, 139, 140, 141, 144, 147, 254, 267, 277, 149, 150, 152, 276, 344

[56] References Cited

U.S. PATENT DOCUMENTS 3,066,514 12/1962 Iketani ..... 431/344
3,213,648 10/1965 Racek ..... 431/131
3,224,235 12/1965 Meylan ..... 431/254
3,994,667 11/1976 Takahashi ..... 431/131

FOREIGN PATENT DOCUMENTS 1101176 10/1955 France .
1191957 10/1959 France ..... 431/277
51-150466 6/1976 Japan .
476085 12/1937 United Kingdom ..... 431/277
1531138 11/1978 United Kingdom .

*Primary Examiner*—Samuel Scott
*Assistant Examiner*—Kenichi Okuno
*Attorney, Agent, or Firm*—Pollock, Vande Sande & Priddy

[57] ABSTRACT

A cigarette lighter including an ignition system of which a striking member support wheel (14) is pivotally supported (17, 18) by a lighter body (10) for pivotal movement in conjunction with the opening and closing movement of a cover (23), to enable the ignition system to be enclosed by the cover when the latter is closed. The lighter further includes a nozzle (11) urged at all times to move upwardly to allow gas to issue therethrough, and a regulating member (20, 21, 25, 26, 27, 29, 31) for the cover operative to move the nozzle downwardly by its underside, so that the nozzle can be automatically moved upwardly to allow gas to issue therethrough when the cover is opened and can be automatically moved downwardly to stop the issuing gas when the cover is closed.

3 Claims, 3 Drawing Figures

CIGARETTE LIGHTER

BACKGROUND OF THE INVENTION

This invention relates to a cigarette lighter of the type using a flint for producing sparks.

A prior art cigarette lighter of the type using a flint for producing sparks comprises a lighter body having a built-in tank and a nozzle disposed in the upper central portion of the lighter body and connected to the tank, an ignition system located in the vicinity of the nozzle including, in addition to the flint, a striking member, a striking member support wheel and a flint holder, and a cover pivotally connected to the lighter body for enclosing the ignition system and the nozzle when moved to a closed position. In this type of cigarette lighter, the striking member support wheel is turned by a finger to strike the flint with the striking member to produce sparks which ignite the gaseous fuel issuing through the nozzle. To this end, the striking member support wheel advantageously extends as far outwardly as possible, to enable the finger to readily manipulate the striking member support wheel. However, when the striking member support wheel extends too far outwardly, difficulties would be encountered in enclosing the ignition system with the cover and it would become necessary to fabricate the cover to conform to the shape of the projecting striking member support wheel. Such cigarette lighter would be unpresentable in its external appearance, and its production cost would increase.

SUMMARY OF THE INVENTION

This invention has been developed for the purpose of obviating the aforesaid disadvantages of the prior art. Accordingly the invention has as its object the provision of a cigarette lighter wherein the conflicting requirements of rendering the striking member support wheel of the ignition system easy to operate and obtaining an acceptable external configuration in a cigarette lighter when the cover is brought to a closed position can be satisfactorily met.

The outstanding characteristic of the invention is that the flint holder is pivotally supported by the lighter body and movable as the cover is opened or closed, so that the striking member support wheel projects outwardly when the cover is opened, to facilitate operation of the striking member support wheel. The striking member support wheel is enclosed by the cover when the latter is closed.

DESCRIPTION OF THE PREFERRED EMBODIMENT

Figure 1:
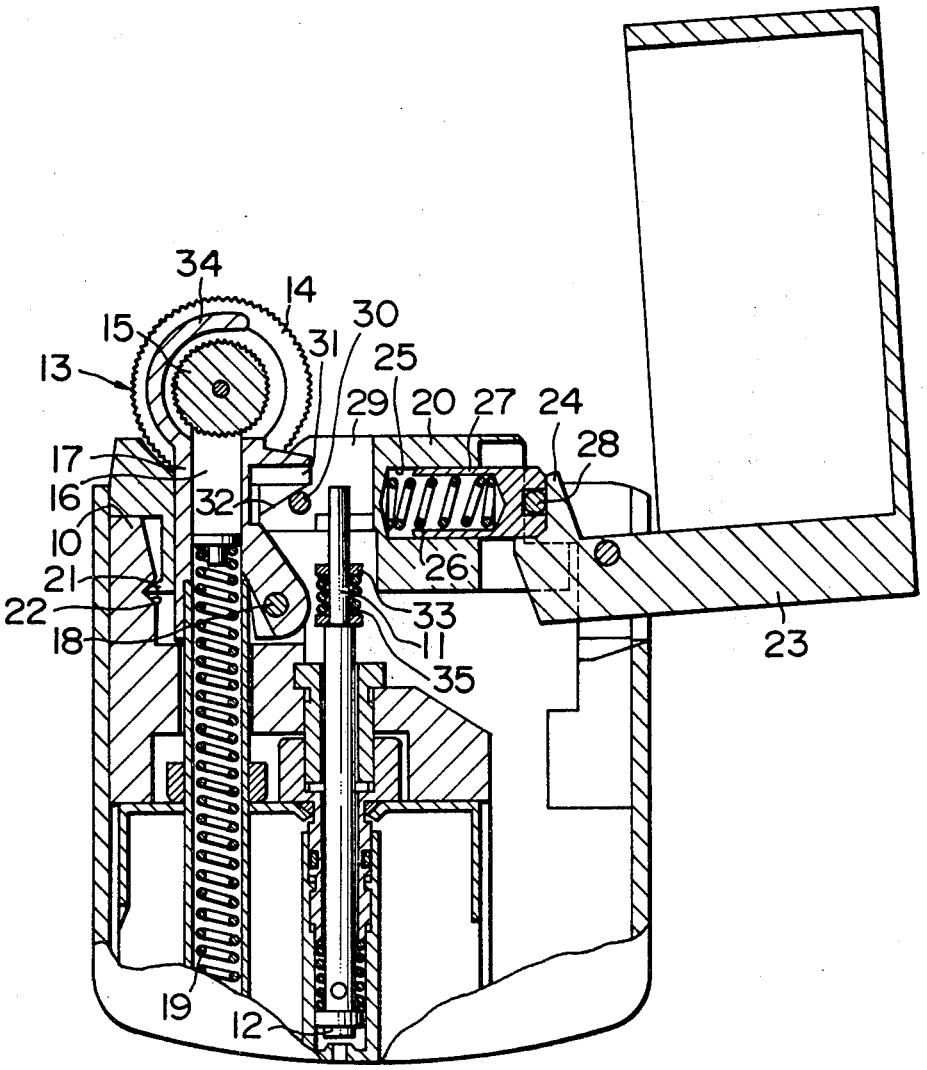
FIG. 1 is a vertical sectional view of the cigarette lighter according to the invention, shown with the cover open.

A preferred embodiment of the invention will now be described by referring to the accompanying drawings. As shown, a lighter body 10 has a built-in gas tank, and a nozzle 11 extending upwardly from the top of the tank. The nozzle 11 has a filter 12 at its lower end.

Ejection of the gas through the nozzle 11 is stopped when the filter 12 is pressed downwardly.

Located in the vicinity of the nozzle 11 is an ignition system 13 comprising a striking member support wheel 14, a striking member 15, a flint 16 and a flint holder 17. The flint holder 17 is pivotally supported at its lower end portion by the lighter body 10 through a pin 18. Mounted in the flint holder 17 is a spring 19 which by its biasing force urges flint 16 to move upwardly into pressing engagement with the striking member 15. The spring 19 extends further downwardly into a tubular member in the gas tank, to urge the flint holder 17 itself to move clockwise.

A regulating member 20 is provided having a central opening 29 which partially surrounds flint holder 17 and nozzle 11. The regulating member 20 is formed at one end thereof with a pivoting projection 21 which is engaged in a recess 22 formed on the inner wall surface of the lighter body 10 in the vicinity of the flint holder 17. At its other end, member 20 is supported by pin 28 attached to the base of a cover 23 which, in turn, is pivotally is supported by the lighter body 10 for movement between the open position of FIG. 1 and the closed position of FIG. 2. More specifically, an L-shaped portion 24 at the lower end of the cover 23 supports pin 28 which engages the forward end of a regulating piston 27 slidably fitted within an opening 25 in member 20 and biased by a spring 26. As a result, the cover 23 can be kept in the open position and the closed position by the action of the regulating member 20.

The central opening 29 in regulating member 20 is substantially elliptical and receives the flint holder 17 so that the striking member support wheel 14 is located on the upper surface. Nozzle 11 also extends into central opening 29. A rod 30 is mounted to regulating member 20 and extends across in the opening 29. An inclined surface 32 on the underside of a projection 31 extending laterally from the upper portion of the holder 17 is in sliding contact with the rod 30.

Meanwhile a portion of central opening 29 disposed above the nozzle 11 serves as a flame port. The gas issuing through the nozzle 11 can be stopped by moving push-down member 33, which is disposed on the nozzle 11, downward by means of a flange extending into the central opening 29 at the bottom of the regulating member 20. The numeral 34 designates a cover for the striking member 15, and the numeral 35 designates a spring which by its biasing force urges nozzle 11 to move upwardly at all times.

Figure 2:
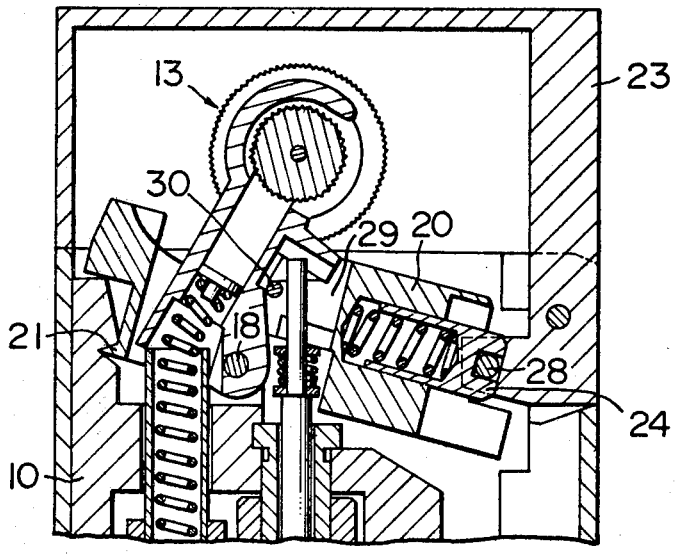
FIG. 2 is a vertical sectional view of the cigarette lighter shown in FIG. 1, with the cover closed.
Figure 3:
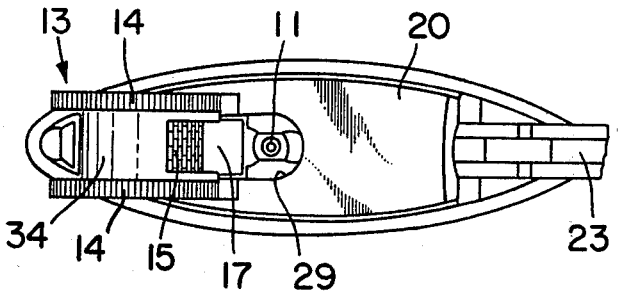
FIG. 3 is a top plan view of a cigarette lighter embodying the invention with the cover partially removed.

Operation of the cigarette lighter of the aforesaid construction will be described. As the lighter is moved to a closed cover condition from an open cover condition shown in FIG. 1, the regulating member 20 rotates clockwise about projection 21. At the same time, the push-down member 33 is engaged by the underside of member 20 as shown in FIG. 2 and moved downwardly. As a result, nozzle 11 moves downwardly and closes thereby stopping the issuing gas. Meanwhile the rod 30 restraining the holder 17 moves downwardly to allow the holder 17 to be pivoted clockwise about pin 18 by the biasing force of the spring 19. As a result striking member support wheel 14 moves inwardly to permit cover 23 to reach a completely closed position.

When the cover 23 is moved from the closed position to an open position, the aforesaid process is followed in reverse.

From the foregoing description, it will be appreciated that according to the invention, the flint holder 17 is pivotally supported by the lighter body and movable as the cover is opened or closed, so that the striking member support wheel 14 projects outwardly when the cover is opened, to facilitate operation of the striking member support wheel. The striking member support wheel is enclosed by the cover when the latter is closed, so that the lighter is presentable in external appearance. The cigarette lighter according to the invention is convenient to use because the constructional features set forth hereinafter enable ignition of the gas to be achieved in one operation since the gas issues through the nozzle simultaneously as the cover is opened. The flint holder is pivotally connected to the lighter body and its pivotal movement is linked to the opening and closing movement of the cover. The striking member support wheel is supported for pivoting movement downward as the cover closes and upward as the cover opens. As the cover opens the nozzle is allowed to move upwardly by the underside of the regulating member 20. As the cover closes, the regulating member pushes downwardly on the nozzle to thereby automatically stop the issuing gas when the cover has closed completely.

What is claimed is:

1. In a cigarette lighter of the type including a lighter body having therein a gas tank, a nozzle extending upwardly from said gas tank, an ignition system located in the upper portion of the lighter body and including a flint holder on which a striking member support wheel, a striking member and a flint are mounted, and a cover pivotally supported by the lighter body and movable between an open position in which the ignition system is exposed and a closed position in which the ignition system is enclosed by the cover, the improvement comprising:

regulating member having an opening, one end of said regulating member being pivotally supported by said lighter body and the other end thereof being pivotably supported by said cover, whereby said regulating member pivots during the opening and the closing movements of said cover;

means for pivotally supporting said flint holder on said lighter body so that said flint holder extends upwardly through said opening of said regulating member;

means for biasing said flint toward said striking member and for urging said flint holder to pivot about said means for pivotally supporting to a lowered position in which said cover can close; and means provided on said regulating member for engaging said flint holder to prevent pivoting of said flint holder to said lowered position when said cover is open and to allow said flint holder to pivot toward said lowered position as said cover is closed;

whereby when said cover is opened said flint holder is maintained in a raised position by said means for engaging and when said cover is closed said regulating member is lowered so that said flint holder is pivoted to said lowered position by said means for biasing.

2. A cigarette lighter as claimed in claim 1, wherein said regulating member has an underside positioned to engage said nozzle and move it downwardly, so that when said cover is moved to its closed position said nozzle is automatically moved downwardly to stop gas issuing therethrough, further comprising means for urging said nozzle upwardly at all times so that when said cover is moved to its open position said underside disengages from said nozzle and said nozzle automatically moves upwardly and issues gas therethrough.

3. A cigarette lighter as claimed in claim 1, wherein said means for engaging said flint holder comprises a rod extending across said opening in said regulating member in position to contact said flint holder and pivot it to said raised position as said cover is opened.

* * * * *